United States Patent [19]

Bresenham et al.

[11] Patent Number: 4,623,880

[45] Date of Patent: Nov. 18, 1986

[54] GRAPHICS DISPLAY SYSTEM AND METHOD HAVING IMPROVED CLIPPING TECHNIQUE

[75] Inventors: Jack E. Bresenham; Adrian C. Gay, both of Hants; John P. Richards, Twickenham, all of United Kingdom

[73] Assignee: International Business Machines, Armonk, N.Y.

[21] Appl. No.: 566,245

[22] Filed: Dec. 28, 1983

[30] Foreign Application Priority Data

Dec. 30, 1982 [EP] European Pat. Off. ..... 82306987.7

[51] Int. Cl.[4] ..... G09G 1/10

[52] U.S. Cl. ..... 340/723; 340/744; 340/747

[58] Field of Search ..... 340/747, 744, 723, 728, 340/724, 703

[56] References Cited

U.S. PATENT DOCUMENTS 4,179,824 12/1979 Marsh .
4,481,594 11/1984 Staggs et al. ..... 340/703
4,492,956 1/1985 Collmeyer et al. ..... 340/723

FOREIGN PATENT DOCUMENTS 2128459 9/1982 United Kingdom ..... 340/747

OTHER PUBLICATIONS

*Proceedings of The Fall Joint Computer Conference,* San Francisco, California, 9th-11th Dec. 1968, A.F.I.P.S. Conference Proceedings, vol. 33, pp. 765-775, Washington, USA.

R. F. Sproull et al.: "A Clipping Divider" Figures 4-6; p. 767, right-hand column, line 9-p. 769, left-hand column, line 22.

*Primary Examiner*—Gerald L. Brigance
*Attorney, Agent, or Firm*—Frederick D. Poag

[57] ABSTRACT

The invention concerns a graphics display system of the kind having a refresh raster display device, a line clipping mechanism for clipping line primitives for viewing in a selected rectangular viewport having horizontal and vertical edges parallel to the X and Y axes respectively of the display area of the display device, and a vector-to-raster converter for converting the clipped lines to patterns of discrete pels in a refresh buffer, the vector-to-raster converter including an incremental line drawing mechanism responsive to line information supplied by the clipping mechanism to draw the line starting at one endpoint and proceeding towards the other. In such a system, for at least some lines of a kind which have a first endpoint in the viewport and the second endpoint outside the viewport, the clipping mechanism is arranged to avoid calculating the intersection point of the line with the viewport edge intersected by the line, and the vector-to-raster converter is arranged to start the line drawing mechanism at the first endpoint and halt the line drawing mechanism when the currently generated coordinate along the display axis normal th the said viewport edge equals the coordinate of the viewport edge along the same axis.

7 Claims, 6 Drawing Figures

GRAPHICS DISPLAY SYSTEM AND METHOD HAVING IMPROVED CLIPPING TECHNIQUE

FIELD OF THE INVENTION

This invention relates to a graphics display system of the kind having a refresh raster display device such as a raster scan CRT, a line clipping mechanism for clipping line primitives for viewing in a selected rectangular viewport having horizontal and vertical edges parallel to the X and Y axes respectively of the display area of the display device, and a vector-to-raster converter (VTR) for converting the clipped lines to patterns of discrete pels in a refresh buffer, the vector-to-raster converter including an incremental line drawing mechanism responsive to line information supplied by the clipping mechanism to draw the line starting at one endpoint and proceeding towards the other.

In particular the invention concerns an improvement in the line clipping and line drawing efficiency of such systems, the term "drawing" referring to the generation of successive incrementally displaced pairs of display coordinates as hereinafter described.

BACKGROUND OF THE INVENTION

Before proceeding with a discussion of the background of the invention, it should be noted that clipping often occurs in a coordinate space other than the device coordinate space, such as world coordinate space, and the rectangular region against which the lines are clipped is normally referred to as a window. On the other hand, since the viewport refers to a specific region of the device display area it is defined in terms of device coordinates. Thus window-to-viewport mapping is required before vector-to-raster conversion is performed, as is well known. Nevertheless, it is quite possible to perform clipping in the device coordinate space and in such case the window and the viewport are one and the same. For convenience, therefore, in the present specification we use the single term viewport to include both the viewport proper, i.e. the rectangular region of the display area defined in device coordinates in which the clipped lines are to be viewed, and also the window against which the lines are clipped by the clipping mechanism, which may or may not be in device coordinates. It is therefore to be understood that when the term viewport is used in relation to clipping it may refer to a window (the predecessor of the viewport proper) in a coordinate space other than device coordinate space, with window-to-viewport mapping being implied if not explicitly stated. Furthermore, where the specification refers to the clipping of a line by the clipping mechanism, it is to be understood that the line is in the coordinate system in which the clipping mechanism operates.

Conventional line clipping mechanisms use the Cohen-Sutherland (CS) technique which is described, for example, on pages 146 and 147 of the book "Fundamentals of Interactive Computer Graphics" by Foley and Van Damm, published 1982 by Addison-Wesley Publishing Co. Ltd. In this technique the area surrounding the viewport is divided into eight regions, herein referred to as outregions, and different outcodes are assigned to the various regions and to the viewport. Certain lines can be quickly eliminated from consideration for clipping by inspection of the outcodes of their endpoints, either because they lie entirely to one side of the viewport or because they lie entirely within the viewport. In the former case the lines are said to be trivially rejected, in the latter case trivially accepted.

The remaining lines may or may not intersect the viewport, and therefore in general the intersection of each line with each of the four boundaries of the viewport is calculated in turn in order to determine the points of intersection, if any, of the line with the edges of the viewport. While in many cases the edge intersections will be found before all four calculations have been made, some lines will nevertheless require the full four calculations. In this connection it is to be understood that in the present specification the term boundary refers to one of the four imaginary infinite lines in the coordinate space concerned, two vertical and two horizontal, which enclose and thereby define the viewport, whereas the term edge refers to only that part of each boundary which lies between the two parallel boundaries perpendicular to it. Furthermore, we are not concerned in the present specification with strictly vertical, horizontal and ±45° lines which do not require complex intersection calculations to be made.

Having determined the intersection points of the line with the viewport, the parts outside the viewport are discarded and information defining the X,Y coordinates of the endpoints of the remaining clipped lines is passed to the VTR, if necessary after mapping as referred to above. This line information, which may be passed directly to the VTR or, for example, indirectly via a display file which is accessed by the VTR, may define both endpoint coordinates explicitly or, where the line starts at the end of a previous line, one endpoint may be defined implicitly by providing only the coordinates of the endpoint remote from the junction with the previous line. The VTR takes the line information thus provided and, using the incremental line drawing mechanism, plots the line pel by pel into the refresh buffer.

As will be recognized by those familiar with point plotting techniques, an incremental line drawing mechanism is a mechanism of the kind in which successive incrementally displaced pairs of X,Y display coordinates are generated by performing one iteration of an interactive computation in respect of each consecutive coordinate unit along a given axis of the line, starting a one endpoint of the line and proceeding towards the other. The mechanism is regarded as stepping along the given axis of the line, and the stepping axis may be the major axis of the line, i.e. that X or Y axis relative to which the line is inclined at less than ±45°, or the minor axis of the line, i.e. the axis normal to the major axis, depending on the nature of the mechanism. Thus, for example, DDA and Bresenham line drawing mechanisms step along the major axis of the line and for each major axis coordinate generate one minor axis coordinate. On the other hand, run-length line drawing mechanism step along the minor axis of the line and for each minor axis coordinate generate a plurality (run) of major axis coordinates. Clearly, one coordinate of each pair generated by the mechanism is simply the current coordinate along the relevant stepping axis. As is well known, the number of iterations performed by the mechanism is controlled by a stepping loop count which is conventionally set by the VTR to the magnitude of the coordinate difference along the stepping axis between the endpoints of the line as defined by the line information supplied by the clipping mechanism.

Conventional incremental line drawing mechanisms generally require each end of the line to lie within the viewport or to be clipped to an edge of the viewport by the clipping mechanism. However, the calculation of the intersection of a line with a viewport boundary is very time-consuming, and this is a particular disadvantage in the case of interactive graphics where a large number of lines must often be processed as quickly as possible to provide a fast feedback to the operator. Thus any improvement in the efficiency of clipping and line drawing operations, in particular by reducing the average number of intersection calculations required per line, will have a significant impact on the time required to process lines for display.

It is therefore an object of the invention to provide an improved line clipping or drawing mechanism which reduces the average number of intersection calculations per line.

SUMMARY OF THE INVENTION

This object is achieved according to the invention by providing that, for at least some lines of a kind which have a first endpoint in the viewport and the second endpoint outside the viewport, the vector-to-raster converter is arranged to start the line drawing mechanism at the first endpoint and automatically halt the line drawing mechanism, irrespective of the coordinates of the second endpoint, when the currently generated coordinate along the display axis normal to the viewport edge intersected by the line equals the coordinate of the viewport edge along the same axis, whereby the need for the clipping mechanism to calculate the intersection point of the line with the said viewport edge is avoided.

The invention is based on the realization that, for lines of the kind specified above, the information required to terminate the line drawing mechanism at the viewport edge, i.e. the coordinate along the relevant display axis of the intersection point of the line with the viewport edge, is simply the coordinate of the edge itself, and since this is known through the initial specification of the viewport there is no need for the clipping mechanism to calculate the actual intersection point. Thus automatic termination of the line drawing mechanism can be achieved irrespective of the coordinate of the second endpoint. In other words implicit clipping of the second endpoint of the line to the viewport edge is achieved without the need for true clipping to the edge by the clipping mechanism.

In the preferred embodiments of the invention the lines of the kind specified above comprise lines (herein referred to as special case lines) for which the second endpoint lies in an outregion laterally adjacent the viewport, and the viewport edge intersected by the line is normal to the stepping axis of the line drawing mechanism. In such circumstances the VTR is arranged to halt the line drawing mechanism when the number of iterations performed by the mechanism equals the magnitude of the coordinate difference along the stepping axis between the first endpoint and the viewport edge. In particular, the VTR halts the line drawing mechanism by setting (forcing) the stepping loop count of the mechanism to the said magnitude irrespective of the coordinate along the stepping axis of the second endpoint which is ordinarily used to set the stepping loop count. FIG. 5 shows an example.

The stepping loop count may, as in the preferred embodiments, be forced to the specified magnitude by calculating the latter in the clipping mechanism and passing it together with the line information as an extra parameter to the VTR. An alternative technique is to pass the line information together with an indication which is interpreted by the VTR that stepping loop count forcing is to be performed, the VTR then calculating for itself the magnitude of the forced count using the coordinate of the first endpoint and the coordinate of the viewport edge which has been previously supplied to and stored in the VTR. In the case of clipping in other than device coordinate space, all parameters must of course be mapped to the viewport.

It is to be understood that although forcing the stepping loop count as described above is the preferred technique, an alternative is to set the stepping loop count in the normal way to the magnitude of the coordinate difference between the first and second endpoints in the direction of the stepping axis, and in each interation of the line drawing mechanism to compare the current stepping axis coordinate with the coordinate of the relevant viewport edge along the same axis, the line drawing mechanism being prematurely halted when the two are the same. This comparison should preferably be performed in parallel with the normal stepping loop count incrementation so as to avoid increasing the interation cycle time of the line drawing mechanism. The comparison is therefore done in parallel hardware while the main iteration is done in hardware or software. Where this comparison technique is used it is not necessary that the viewport edge intersected by the line be normal to the stepping axis of the line drawing mechanism, provided that the comparison is effected between the currently generated coordinate along the display axis normal to the viewport edge and the coordinate of the viewport edge along the same axis.

Although the direction of drawing a line is normally specified by the system user, usually implicitly from the order in which the line endpoints are presented to the system, most modern systems are permitted to choose the actual direction of line drawing according to convenience. In such case all special case lines can be drawn without the need for true clipping of the second endpoint to the viewport edge. Nevertheless, where for one reason or another the system is constrained to draw lines in the direction specified by the system user, only those special case lines specified for drawing in the direction from the first to the second endpoints benefit from the invention. However, this is likely to apply to only a few systems and it will be assumed in the remainder of this specification that line drawing in either direction is possible at the discretion of the system, irrespective of the initially specified direction.

It will be recognized that if the special case line as defined above includes not only lines which satisfy the specified condition ab initio but also lines which have already been subject to partial clipping by the clipping mechanism, the invention provides the ability to avoid one clipping operation (i.e. intersection calculation) in respect of any line which is, or can be reduced to, the special case, thereby saving valuable time in processing unclipped lines for display. This is particularly advantageous in respect of interactive displays where a fast feedback to the operator is required.

Since any line can be reduced to a special case line or to a line with both ends in the viewport in three intersection calculations at most, all possible lines can be dealt with in no more than three clipping operations if line drawing in either direction is assumed. This contrasts with the prior art where many lines require four such operations.

A first embodiment of the invention, which assumes that a line drawing mechanism is used whose stepping axis corresponds to the major axis of the line, is based upon the following two observations:

(1) For any line, other than a special case line, having a first endpoint within the viewport and a second endpoint outside the viewport (herein referred to as a class A line), a single clipping operation on the second endpoint against the nearest viewport boundary parallel to the major axis of the line will either result in a special case line or a line having its second endpoint within the viewport. In neither case is any further clipping of the second endpoint required, in the former case because implicit clipping can be performed by the VTR and in the latter case because both endpoints now lie within the viewport and the line can be drawn in the normal fashion.

(2) Since clipping the endpoint of any arbitrary partially visible line in turn against the two nearest mutually perpendicular viewport boundaries will bring the endpoint within the viewport in, at most, two clipping operations, for any line having both endpoints outside the viewport (herein referred to as a class B line), two clipping operations at most on one endpoint against the two nearest mutually perpendicular viewport boundaries together with a single clipping operation on the other endpoint against the nearest viewpoint boundary parallel to the major axis of the line will, in the case of a partially visible class B line, either result in a special case line or a line having both endpoints within the viewport. In neither case is any further clipping required by the clipping mechanism for the reasons given in (1). In the case of a wholly invisible class B line the two clipping operations on the first endpoint alone will be sufficient to identify the line as invisible, if that has not previously been possible by standard trivial rejection, whereafter no further action is required.

These observations demonstrate that, assuming lines capable of trivial rejection or acceptance to have been dealt with in conventional manner, any other partially visible or wholly invisible line may be reduced either to a wholly visible line or to a special case line in at most three clipping operations, which is therefore the maximum needed to draw these lines using the first embodiment of the invention. This contrasts with the prior art where many lines require four such operations before line drawing can be performed.

A second embodiment of the invention is a modification of the first embodiment with enhanced function, and is based upon the recognition that the coordinate generated at each iteration along the axis normal to the stepping axis can also be used as a control for the line drawing mechanism, in addition to the control exercised by the stepping axis coordinate. Thus, according to this second embodiment, for lines of the kind having a first endpoint within the viewport and the second endpoint outside the viewport (herein referred to as a class C line), the VTR is arranged to halt the line drawing mechanism either when the number of iterations performed equals the magnitude of the coordinate difference along the stepping axis between the first endpoint and that viewport boundary which is normal to the stepping axis and on the same side of the first endpoint as the second endpoint, or when the current generated coordinate along the axis normal to the stepping axis equals the coordinate along the same axis of that viewport boundary which is parallel to the stepping axis and on the same side of the first endpoint as the second endpoint, whichever occurs first.

Preferably, as in the first embodiment, the VTR halts the line drawing mechanism after performing the said number of iterations by forcing the stepping loop count of the mechanism to the said magnitude irrespective of the coordinates of the second endpoint. The determination of when the coordinate along the axis normal to the stepping axis equals the coordinate of the viewport boundary parallel to the stepping axis is preferably performed by parallel hardware so as to avoid increasing the iteration cycle time of the line drawing mechanism. It will be noted that the class C lines in fact consists of all special case lines (as defined for the first embodiment) together with all class A lines, but does not distinguish between them.

Since, using the technique of the second embodiment, any class C lines can be drawn without the need for the clipping mechanism to perform any clipping operations, and since any class B line can be reduced to a class C line, or to a wholly invisible line capable of trivial rejection, by clipping one endpoint in turn against the two nearest mutually perpendicular viewport boundaries, all lines can be reduced to a drawable form in a maximum of two clipping operations, as compared to the maximum of three required by the first embodiment. This second embodiment will, of course, deal with those class C lines which are special case lines in the same way as the first embodiment, the difference being that the clipping mechanism is not required to distinguish such lines from class A lines.

Graphics display systems of the kind defined in the first paragraph of this specification are well known; see for example the abovementioned book "Fundamentals of Interactive Computer Graphics", in particular chapters 3 and 10 to 12. Since the invention is of general applicability to any system of this kind it is not thought necessary to give a detailed description of any specific system in the present specification, as the means by which the invention may be implemented in any given system will be readily apparent to those skilled in the art. Nevertheless, for the purpose of illustration and by way of example only, one specific graphics display system in which the present invention could be incorporated is described in section 10.8 of the above book, and illustrated in FIG. 10.16. FIG. 6 of the specification shows a diagram of such a system. However, in view of the general applicability of the invention the following description will be limited to the preferred embodiments of the improved line clipping and line drawing mechanisms wherein the present invention lies. Furthermore, these mechanisms are illustrated by way of flow diagrams only, since given these their implementation (which may be in hardware or software or a mixture of both) is a matter of routine skill for the person familiar with logic or software design in computer graphics systems.

BRIEF DESCRIPTION OF THE DRAWINGS

The embodiments of the invention will now be described, by way of example, with reference to the accompanying drawings, wherein.

DESCRIPTION OF THE PREFERRED EMBODIMENTS

Figure 1:
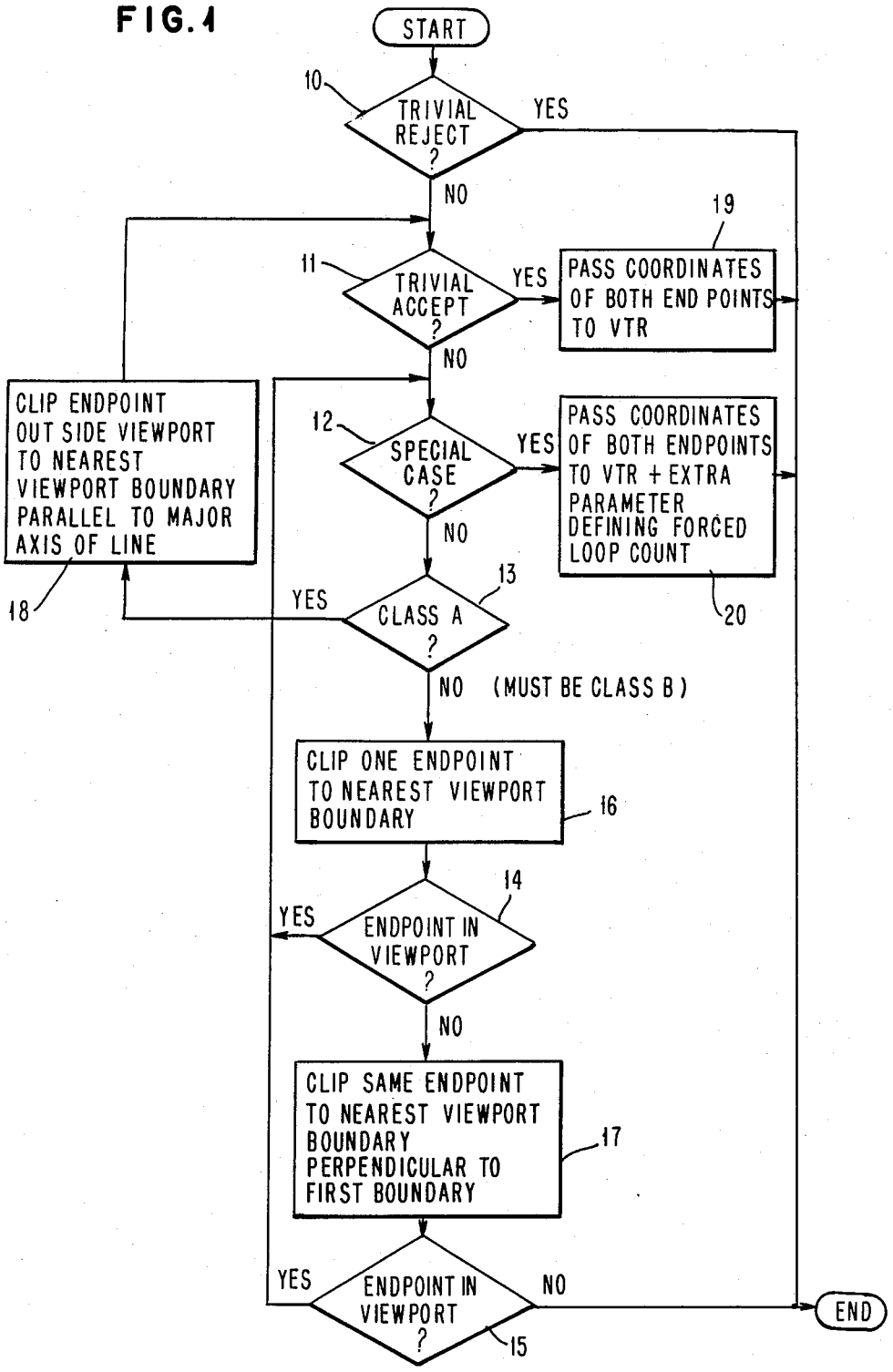
FIG. 1 is a flow diagram of an improved line clipping mechanism forming part of the first embodiment of the invention.

The embodiment of the clipping mechanism shown in FIG. 1 assumes that the line drawing mechanism is of the kind which has a stepping axis corresponding to the major axis of the line.

The mechanism first operates to determine whether the line currently under consideration can be trivially rejected, box 10, or trivially accepted, box 11. These determinations are made in conventional fashion according to the above referenced textbook. In the case of trivial acceptance the line endpoint coordinates $(X_1,Y_1)(X_2,Y_2)$ are passed to the VTR, box 19.

Next, box 12, the mechanism tests for the special case line, defined above. This is achieved by first examining the outcodes of the endpoints for the condition one outcode equals "0000" and the other outcode equals "1000", "0100", "0010" or "0001", and if this condition if fulfilled by comparing the difference between the X coordinates of the line endpoints with the difference between the Y coordinates of the line endpoints to determine if the major axis of the line is normal to the viewport edge intersected by the line.

If a special case line is found the coordinates of both endpoints are passed to the VTR plus an extra parameter defining the forced stepping loop count, box 20. In particular, for the special case line the clipping mechanism passes:

Line endpoint coords $(X_1,Y_1)(X_2,Y_2)$+extra parameter N, where N =

$(X_R-X_1)$ for X-major lines with $X_2>X_1$, $(X_1-X_L)$ for X-major lines with $X_2<X_1$, $(Y_T-Y_1)$ for Y-major lines with $Y_2<Y_1$, and where $X_L$=X coordinate of viewport left boundary, $X_R$=X coordinate of viewport right boundary, $Y_T$=Y coordinate of viewport top boundary, and $Y_B$=Y coordinate of viewport bottom boundary.

In both the special case line and the trivially accepted line the endpoint $(X_1,Y_1)$ is the starting point of the line drawing mechanism, and therefore for the special case line the endpoint $(X_1,Y_1)$ must be the endpoint in the viewport. However, as explained above, the starting point $(X_1,Y_1)$ may be omitted if the line starts implicitly at the end of the previous line.

The next test, box 13, is for a class A line. The test is simply whether one endpoint has an outcode "0000", it being recalled that special case lines which would otherwise satisfy this test have already been identified and dealt with. If a class A line is found the endpoint outside the viewport is clipped to the nearest viewport boundary parallel to the major axis of the line, box 18. The major axis of the line is determined by comparing the difference between the X coordinates of the line endpoints with the difference between the Y coordinates of the line endpoints, and the nearest parallel viewport boundary is determined by a comparison of coordinates in the direction of the minor axis of the line. As mentioned above, such clipping will reduce a class A line either to a wholly visible line or to a special case line. The mechanism therefore retests for these as indicated by the feedback to the input of box 11.

If a class A line is not found the line can only be a class B line, and one endpoint is clipped to the nearest viewport boundary, box 16. The line is then tested to see whether the clipped endpoint is on an edge of the viewport, box 14, and if so the class B line has been reduced to a special case or class A line. The mechanism thus retests for these as indicated.

If the singly clipped endpoint is not on a viewport edge the same endpoint is clipped to the nearest viewport boundary perpendicular to the first boundary, box 17. Again the resulting endpoint is tested for being on an edge of the viewport, box 15, and if so the class B line has been reduced to a special case line or a class A line. The mechanism thus retests for these. It is to be observed that the test in boxes 14 and 15 is simply whether the outcode of the endpoint is "0000". If the test in box 15 is negative, the line is wholly invisible and is therefore rejected.

Figure 2:
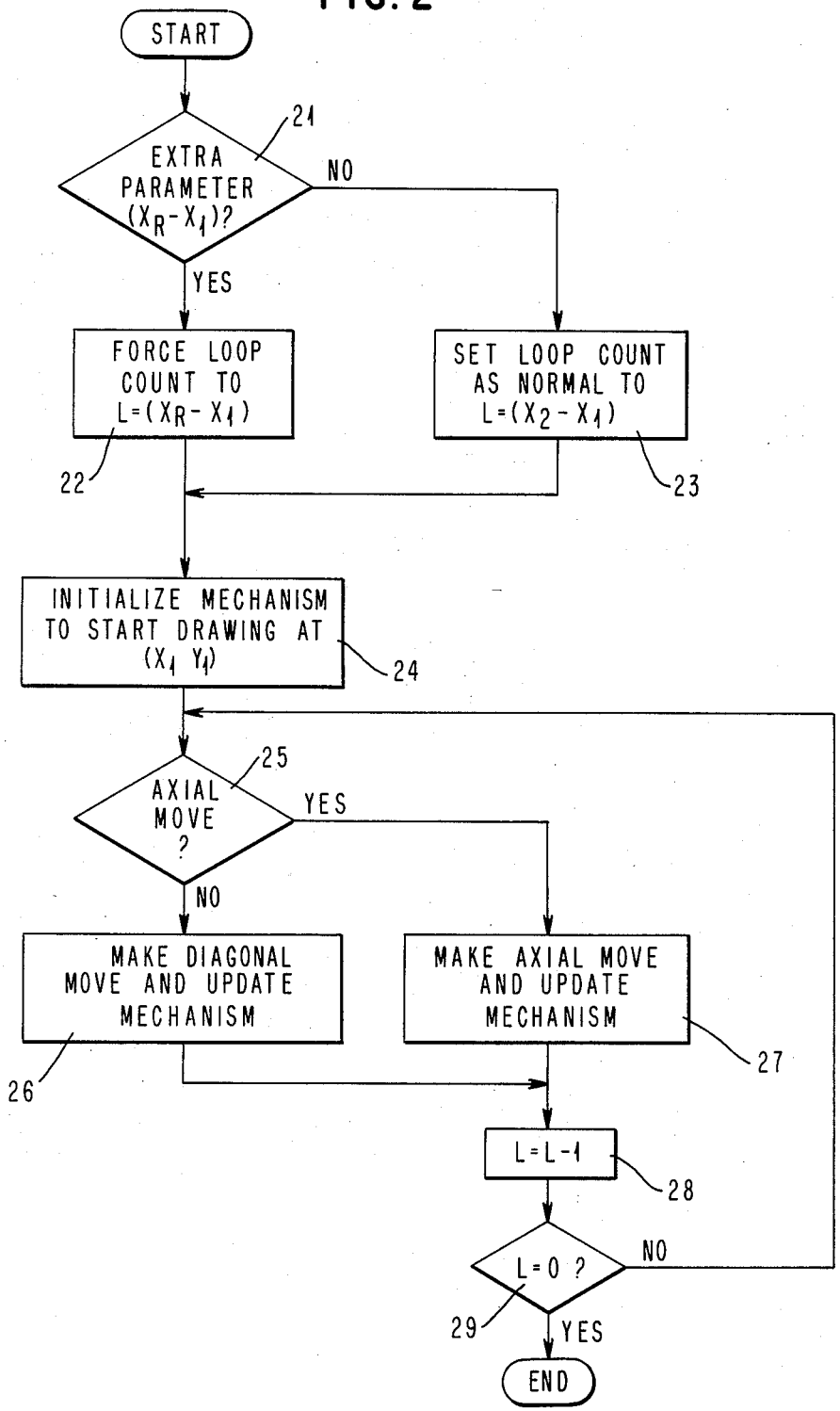
FIG. 2 is a flow diagram of an improved incremental line drawing mechanism for use with the clipping mechanism of FIG. 1 and forming the remaining part of the first embodiment of the invention.

The associated incremental line drawing mechanism for use with the above described clipping mechanism is shown in FIG. 2. As is conventional, for convenience of explanation the operation of the mechanism is shown for an X-major line in the first octant, i.e. $X_2>X_1$, $Y_2>Y_1$ and $(Y_2-Y_1)>(X_2-X_1)$, since the extension of the mechanism to lines in the other octants is readily performed by those skilled in the art. Furthermore, the mechanism is assumed to be a Bresenham-type mechanism wherein the calculation in respect of each consecutive stepping axis coordinate either generates a unit move along the stepping axis (axial move) or a unit move in a diagonal direction (diagonal move). In the first octant, for an axial move the new line coordinates generated by the mechanism are $(X+1,Y)$ where $(X,Y)$ are the previous coordinates, and for a diagonal move the new line coordinates are $(X+1,Y+1)$.

The line drawing mechanism initially determines (box 21) whether an extra parameter (box 20, FIG. 1) has been passed by the clipping mechanism, indicating that the stepping loop count is to be forced. If not, box 23, the VTR sets the loop count L as normal to the coordinate difference between the two endpoints of the line along the stepping axis, in this case to $(X_2-X_1)$. Otherwise, box 22, the loop count L is forced to the value $(X_R-X_1)$. Thereafter the line drawing mechanism is initialized to start drawing at $(X_1,Y_1)$, box 24. Such initialization is performed in conventional manner and involves calculating the parameters E (error term), K1 and K2 for the line using the endpoint coordinates $(X_1,Y_1)(X_2,Y_2)$ explicitly or implicitly supplied by the clipping mechanism (box 23, FIG. 1).

The remainder of FIG. 2 (boxes 25 to 29) is completely conventional; thus the mechanism determines whether an axial step is to be made (box 25), makes the axial step (box 27) or alternatively makes a diagonal step (box 26), decrements the loop count L by 1 (box 28), and finally tests for the termination of the operation (box 29).

Figure 3:
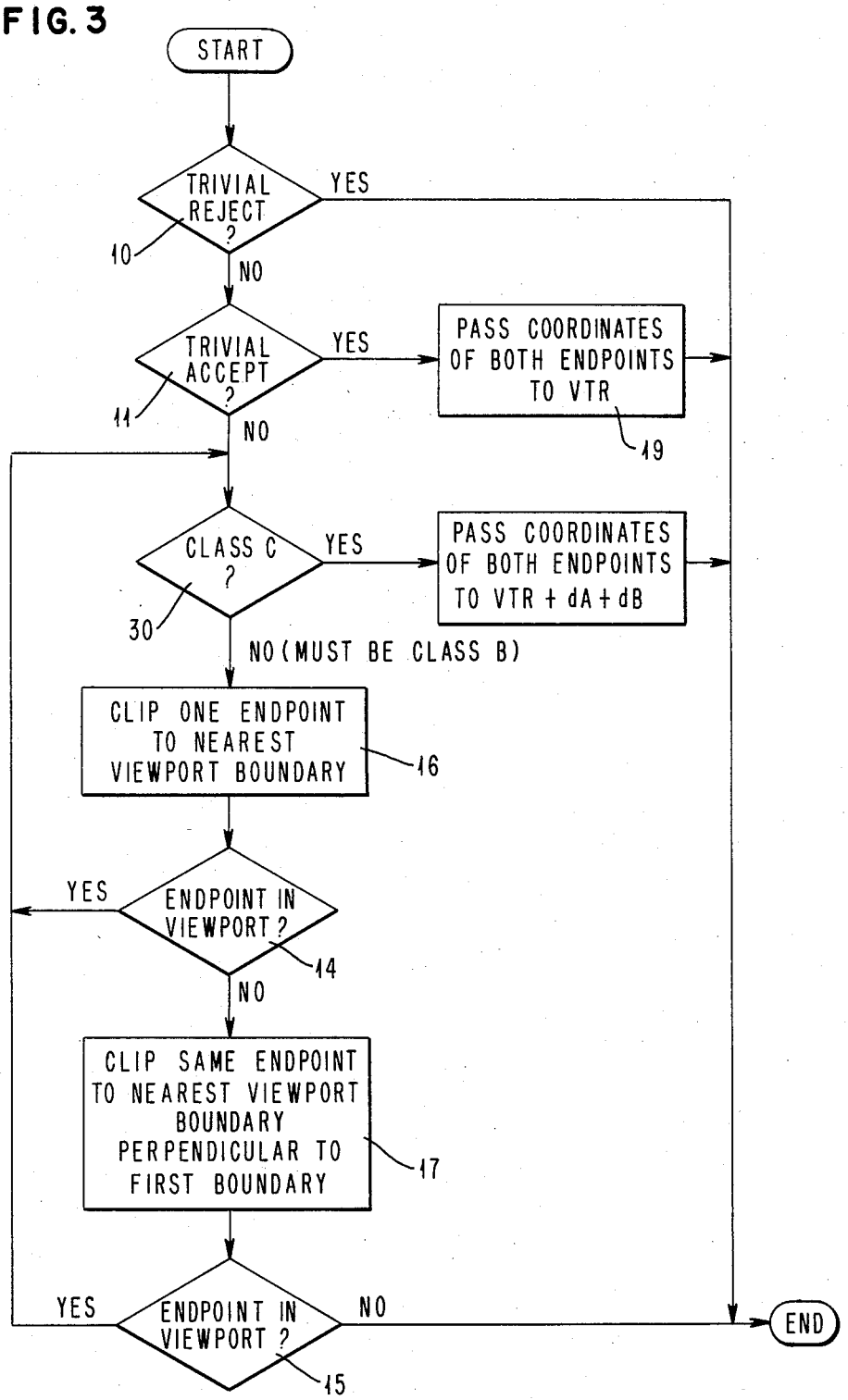
FIGS. 3 and 4 are flow diagrams respectively of a further line clipping mechanism and further line drawing mechanism together forming the second embodiment of the invention.
Figure 4:
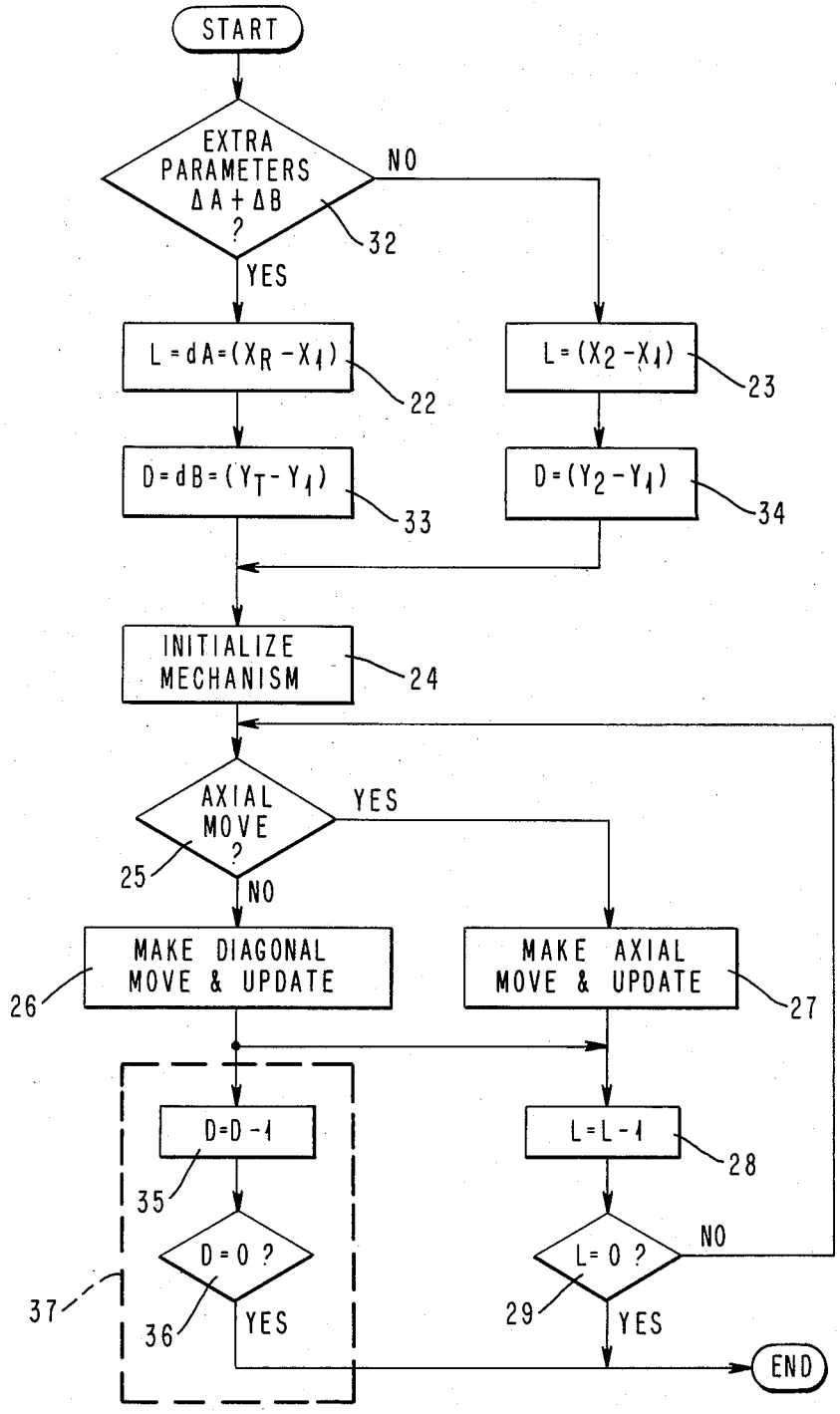
Figures 5, 6:
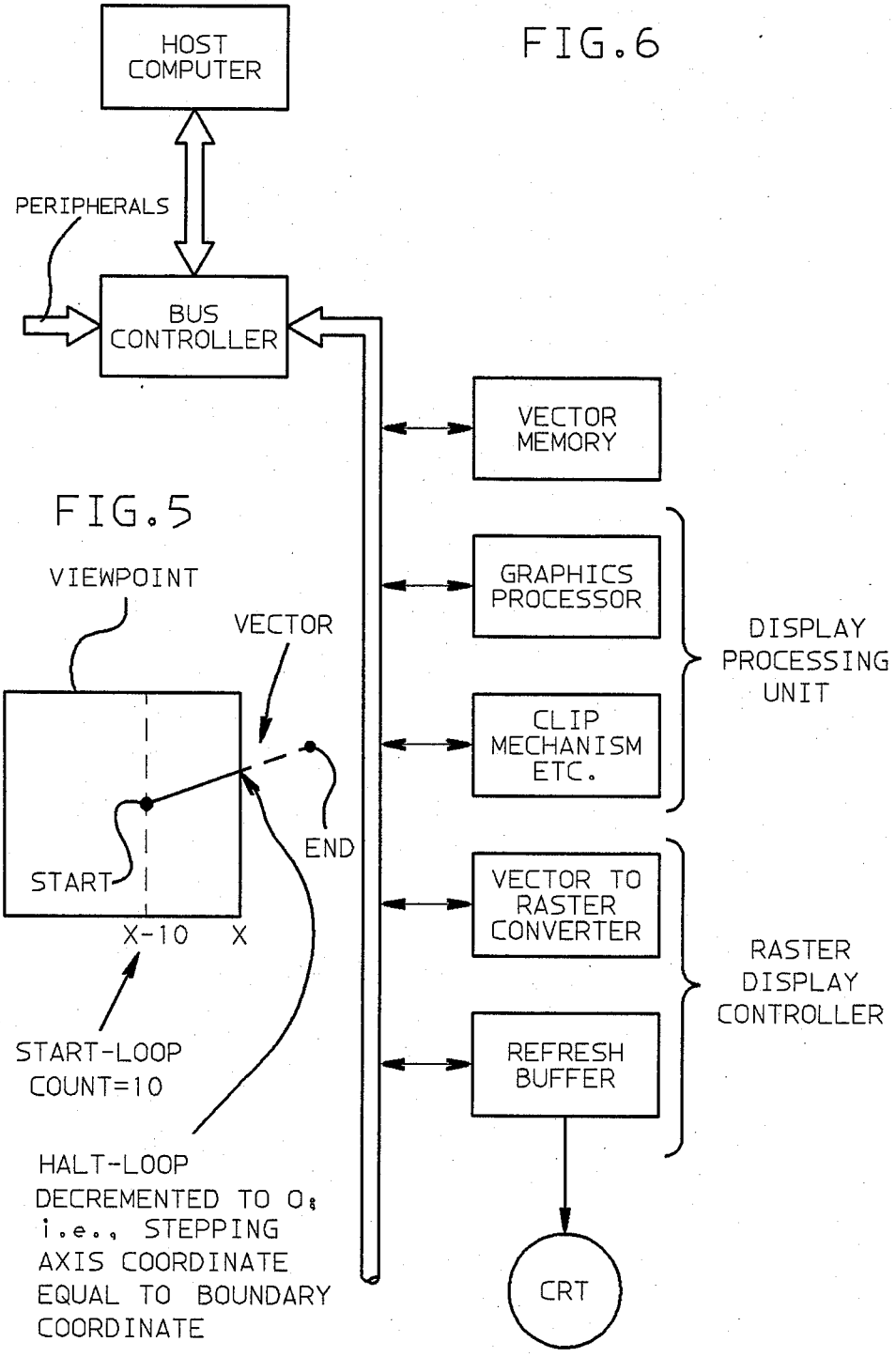
FIG. 5 shows an example of vector clipping during execution of rasterization of a special case line of the X major axis kind, wherein the stepping axis is horizontal.
FIG. 6 shows a typical graphics system in which the invention can be embodied and performed.

The second embodiment of the invention comprises the clipping mechanism of FIG. 3 and the incremental drawing mechanism of FIG. 4.

In FIG. 3 boxes numbered the same as boxes in FIG. 1 perform precisely the same function. The basic difference between the two embodiments is that the second embodiment does not test for special case lines independently of class A lines, but tests only for class C lines which in fact simply consists of the two former classes of line. The test for class C lines in FIG. 3 is therefore the same as the test for class A lines in FIG. 1, i.e. does one endpoint have an outcode "0000"? Thus, as compared with FIG. 1, in FIG. 3 the boxes 12, 13 and 18 are removed and replaced by the box 30, although the latter is only distinguished as regards nomenclature since it in fact performs the same test as box 13 in FIG. 1.

If a class C line is detected, box 30, the coordinates of both endpoints are passed to the VTR together with two extra parameters, box 31. In particular the following is passed:

$$(X_1,Y_1)(X_2Y_2)+dA+dB$$

where dA = distance along major axis of line from $(X_1Y_1)$ to that viewport boundary which is normal to the major axis and on the same side of $(X_1Y_1)$ as $(X_2Y_2)$, and dB = distance along minor axis of line from $(X_1Y_1)$ to that viewport boundary which is normal to the minor axis and on the same side of $(X_1Y_1)$ as $(X_2Y_2)$.

The line drawing mechanism associated with this second clipping mechanism is shown in FIG. 4. Again, the mechanism is shown for first octant lines and boxes numbered the same as in FIG. 2 perform an identical function. It will be seen that when the additional parameters dA and dB are received, box 32, the stepping loop count L is forced, as before, to $(X_R-X_1)$, but in addition a diagonal control count D is set to $dB=(Y_T-Y_1)$, box 33. The diagonal control count D is decremented after each diagonal step, box 35, and tested for zero, box 36, with the effect that the line drawing is halted either when the loop count L decrements to zero, or prematurely when the diagonal control count decrements to zero if this occurs first. The broken line 37 around the boxes 35 and 36 indicate that this function is carried out in parallel to the main loop functions of boxes 28 and 29 so that the overall interation cycle time is not increased. The functions of boxes 35 and 36 are therefore preferably carried out in hardware while the main loop may be performed in hardware or software as desired.

We claim:

1. In a graphics display system of the kind having a refresh raster display device, a line clipping mechanism for clipping line primitives for viewing in a selected rectangular viewport having horizontal and vertical edges parallel to the X and Y axes respectively of the display area of the display device, and a vector-to-raster converter for converting the clipped lines to patterns of dicrete pels in a refresh buffer, the vector-to-raster converter including an incremental line drawing mechanism responsive to line information supplied by the clipping mechanism to draw the line starting at one endpoint and proceeding towards the other, said mechanism being of the kind in which successive incrementally displaced pairs of X,Y disply coordinates are generated by performing one iteration of an interactive computation in respect of each consecutive coordinate unit along a given stepping axis of the coordinate system, the improvement wherein for at least some lines of a kind which have a first endpoint in the viewport and the second endpoint outside the viewport the vector-to-raster converter is arranged to start the line drawing mechanism at the first endpoint and automatically halt the line drawing mechanism, irrespective of the coordinates of the second endpoint, when the currently generated coordinate along the display axis normal to the viewport edge intersected by the line equals the coordinate of the viewport edge along the same axis, whereby the need for the clipping mechanism to calculate the intersection point of the line with the said viewport edge is avoided.

2. A display system as claimed in claim 1, wherein the said lines of the kind referred to comprise lines for which the second endpoint lies in an outregion laterally adjacent the viewport and the viewport edge intersected by the line is normal to the stepping axis of the line drawing mechanism, and wherein the vector-to-raster converter is arranged to halt the line drawing mechanism when the number of iterations performed by the mechanism equals the magnitude of the coordinate difference along the stepping axis between the first endpoint and the viewport edge.

3. A display system as claimed in claim 2, wherein the said lines further comprise lines for which the second endpoint may lie in any other outregion, and wherein the vector-to-raster converter is arranged to halt the line drawing mechanism either when the number of iterations performed equals the magnitude of the coordinate difference along the stepping axis between the first endpoint and that viewport boundary which is normal to the stepping axis and one the same side of the first endpoint as the second endpoint, or when the currently generated coordinate along the axis normal to the stepping axis equals the coordinate along the same axis of that viewport boundary which is parallel to the stepping axis and on the same side of the first endpoint as the second endpoint, whichever occurs first.

4. A display system as claimed in claim 2 or 3, wherein the vector-to-raster converter includes a stepping loop count mechanism and halts the line drawing mechanism after performing the said number of iterations by setting the stepping loop count of said count mechanism to the said magnitude irrespective of the coordinates of the second endpoint.

5. In a graphics display system of the kind having a refresh raster display device, a line clipping mechanism for clipping line primitives for viewing in a selected rectangular viewport having horizontal and vertical edges parallel to the X and Y axes respectively of the display area of the display device, and a vector-to-raster converter for converting the clipped lines to patterns of discrete pels in a refresh buffer, the vector-to-raster converter including an incremental line drawing mechanism responsive to line information supplied by the clipping mechanism to draw the line starting at one endpoint and proceeding towards the other, said mechanism being of the kind in which successive incrementally displaced pairs of X,Y display coordinates are generated by performing one iteration of an interactive computation in respect of each consecutive coordinate unit along a given stepping axis of the coordinate system, an improved method of drawing a line of a kind which has a first endpoint in the viewport and the second endpoint outside the viewport which comprises causing the vector-to-raster converter to start the line drawing mechanism at the first endpoint and automatically halt the line drawing mechanism, irrespective of the coordinates of the second endpoint, when the current generated coordinate along the display axis normal to the viewport edge intersected by the line equals the coordinate of the viewport edge along the same axis, whereby the need for the clipping mechanism to calculate the intersection point of the line with the said viewport edge is avoided.

6. A method as claimed in claim 5, wherein the second endpoint of the line lies in an outregion laterally adjacent the viewport and the viewport edge intersected by the line is normal to the stepping axis of the line drawing mechanism, and wherein the vector-to-raster converter halts the line drawing mechanism when the number of iterations performed by the mechanism equals the magnitude of the coordinate difference along the stepping axis between the first endpoint and the viewport edge.

7. A method as claimed in claim 6, wherein the vector-to-raster converter includes a stepping loop count mechanism and halts the line drawing mechanism by setting the stepping loop count of said count mechanism to the said magnitude irrespective of the coordinates of the second endpoint. C

* * * * *